US008113689B2

(12) United States Patent
Mayo et al.

(10) Patent No.: US 8,113,689 B2
(45) Date of Patent: Feb. 14, 2012

(54) NON-LETHAL PROJECTILE FOR DISORIENTING ADVERSARIES

(75) Inventors: Michael W. Mayo, Austin, TX (US); Daniel R. Mitchell, Austin, TX (US); Michael K. McAleer, Austin, TX (US); Byron G. Zollars, Georgetown, TX (US); Michael G. Durrett, Austin, TX (US); Keith D. Jamison, Austin, TX (US)

(73) Assignee: Nanohmics, Inc., Austin, TX (US)

( * ) Notice: Subject to any disclaimer, the term of this patent is extended or adjusted under 35 U.S.C. 154(b) by 1275 days.

(21) Appl. No.: 11/715,565

(22) Filed: Mar. 8, 2007

(65) Prior Publication Data

US 2008/0216699 A1 Sep. 11, 2008

(51) Int. Cl.
*F21V 33/00* (2006.01)

(52) U.S. Cl. ..... 362/253; 362/112; 362/800; 89/1.11; 102/367

(58) Field of Classification Search ..... 362/112, 362/253, 800; 102/367; 315/56–58, 149; 89/1.11
See application file for complete search history.

(56) References Cited

U.S. PATENT DOCUMENTS 3,721,840 A * 3/1973 Yamada ..... 310/334
5,222,798 A 6/1993 Adams
5,243,894 A 9/1993 Minovitch
5,307,519 A * 4/1994 Mehta et al. ..... 455/343.1
5,685,636 A 11/1997 German
6,007,218 A 12/1999 German et al.
6,065,404 A 5/2000 Ripingill, Jr. et al.
6,190,022 B1 2/2001 Tocci et al.
6,237,461 B1 * 5/2001 Poole ..... 89/1.11
6,367,943 B1 * 4/2002 Tocci et al. ..... 362/103
6,373,384 B1 * 4/2002 Ferguson et al. ..... 340/540
6,460,460 B1 * 10/2002 Jasper et al. ..... 102/201
6,575,597 B1 6/2003 Cramer et al.
6,767,108 B1 * 7/2004 Blachowski et al. ..... 362/112
6,799,868 B2 10/2004 Brown et al.
7,345,320 B2 * 3/2008 Dahm ..... 257/99
2005/0243224 A1 11/2005 Choi et al.
2006/0287114 A1 * 12/2006 Luong ..... 463/51
2007/0273290 A1 * 11/2007 Ashdown et al. ..... 315/113

* cited by examiner

*Primary Examiner* — Dmitry Suhol
*Assistant Examiner* — Jay Trent Liddle
(74) *Attorney, Agent, or Firm* — Claude Cooke, Jr.; John J. Love; Cooke Law Firm

(57) ABSTRACT

Projectile apparatus is provided employing light and sound that may be dispersed over a large area with high intensity to produce a non-lethal, visible and audible countermeasure to temporarily blind and/or disorient one or multiple potential adversaries. The apparatus is suitable for use in tactical scenarios by military, police, and special operations personnel. The apparatus is also suitable for use in training operations for military, police, and special operations personnel. For amusement or recreation, the apparatus may be used in simulated warfare or in games such as paintball.

13 Claims, 11 Drawing Sheets

NON-LETHAL PROJECTILE FOR DISORIENTING ADVERSARIES

BACKGROUND OF THE INVENTION

1. Field of the Invention

This invention pertains to devices for disorienting adversaries. More particularly, light- and sound-producing apparatus is provided in a device that may be hurled or projected toward a person to be temporarily disoriented.

2. Description of Related Art

Currently, military, law-enforcement, and other agencies rely on pyrotechnic stun grenades as a non-lethal means of visually distracting, disorienting, or temporarily disabling personnel. The current generation of stun grenades have modest proven effectiveness, last only a short time, can injure the user or innocent bystanders and cannot be used where there is a danger of starting a fire or in areas where explosive gases are present (e.g. ship holds, aboard aircraft, methamphetamine laboratories). Accordingly, there is a need for a non-pyrotechnic replacement for the existing stun grenades that provides the capability of disorienting adversaries. There is also a need for a safe, reuseable, non-pyrotechnic projectile for training law enforcement or military personnel for certain scenarios where disorienting an adversary or adversaries is advantageous. In this case, for training, the non-pyrotechnic projectile would substitute for the pyrotechnic version. In this case, for training, the non-pyrotechnic projectile would substitute for the pyrotechnic version. In addition, there is a need for a safe, reuseable non-pyrotechnic projectile for disorienting opposing players (simulated adversaries), or for simulating grenades or other explosive devices in the game of "paintball" or other similar simulated warfare games.

At present, commercially available optical less-than-lethal systems can be divided into two categories: stun or flash-bang grenades, and laser dazzlers. Each of these systems has certain advantages and limitations. Flash-bang devices, such as the M84 Stun Grenade, manufactured and sold by Goodrich Universal Propulsion Company (UPCO), combine bright light (1 million candela) and painful sound levels (170 dB) to confuse, distract and disorient personnel. However, detonation of stun grenades in the presence of natural gas, gasoline, solvents, or other flammable fumes or materials may result in serious secondary explosions or fire. In addition, injury to personnel could result if the grenade activates prior to being deployed or if it lands too close to an adversary or bystander.

Laser dazzlers use red or green diode lasers operating in a pulsed or continuous format to temporarily blind or obscure the vision of adversaries. However, concerns over eye safety of these devices are limiting their use. A similar device called the Veiling Glare Laser is under development that uses 365 nm laser light to cause the eyes' lens to fluoresce, causing the retina to be flooded with light that interferes with normal image formation. Laser dazzler devices are inherently very directional, thereby limiting their utility for crowd dispersal or for instances where there is more than one adversary.

In a discussion of human response to visible optical energy, it is important to distinguish between the physical description of the incident electromagnetic wave and the visual perception of that incident wave by the human eye and brain. Light is defined as the visual sensation of radiant power. Radiant power (or radiant flux) is a physical term and is equal to the amount of electromagnetic wave energy per unit time. Photometry describes the visual perception of light from a human observer standpoint and can be described as the aspect of radiant power that evokes a visual sensation as a result of stimulation of the human retina. The wavelength range that normal humans can perceive is from approximately 400 nm to 700 nm. For an equal radiant power at every wavelength across the visual spectrum, the normal human observer will perceive a wavelength-dependent brightness that is a function of the spectral responsivity (sensitivity as a function of wavelength) of the rods and cones that comprise the retina. The standard response of normal daylight-adapted humans (photopic vision) is centered at approximately 555 nm and decreases uniformly for both shorter and longer wavelengths. The responsivity of the human eye at 480 nm (blue-green light) is only about $1/10^{th}$ that of 555 nm (yellowish green) light. Therefore, when exposed to equal irradiances ($W/cm^2$) of 480 nm and 555 nm light, a normal daylight-adapted human will perceive the 555 nm light to be ten times as bright. It is worthwhile to also note that the responsivity of the standard human dark-adapted eye (scotopic vision) is blue-shifted with respect to photopic vision, and is centered around 510 nm (green). Therefore, light with wavelengths from 510 nm to 555 nm provide the highest human visual response per unit of radiometric power. This is an important ingredient for the development of a high-intensity light source designed to startle, disorient, or temporarily incapacitate in either a day or night situation.

Repetitively flashing lights have been shown to cause seizures and disorientation in both epileptics and normal humans. Because of this, many countries have laws governing the use of flashing lights in public places. Effects such as nausea, vomiting and seizures have been directly linked to the excessive use of flashing lights at repetition frequencies from 3-15 Hz. Military programs dating back to World War I have investigated the use of high-power strobe lights as a source to disorient, and even create seizures in enemy forces.

It is well known that bright lights, particularly those with wavelengths near the peak of the human retinal responsivity can cause glare, flashblindness and afterimages. These effects can cause disorientation of humans because of loss or degradation in their visual function. The possible adverse effects on vision as a result of exposure to very bright light sources can vary from the relatively minor glare, to flashblindness, and finally to debilitating (and permanent) retinal lesions as the radiant exposure (or irradiance) increases. It is worthwhile to note that looking directly in to the sun for more than one second can cause permanent damage to the human retina. The particular negative effect on vision will be both a function of the light source characteristics (e.g. wavelength, power or energy, pulse-width, repetition frequency, etc.), the state of adaptation of the observer (photopic or scotopic vision), and propagation effects (e.g. atmospheric scattering, absorption, and reflection from other objects).

Unlike coherent radiation from a laser that focuses to a small spot on the retina and thus produces a high peak radiant power density on the retina, the extended source of an incoherent light generates a broadened image on the human retina and thus a larger spot size with a correspondingly lower peak radiant power density. It is well known that incoherent sources of light are thus much safer than a coherent light source of the same total power. In addition, the larger retinal image of an incoherent source increases the vulnerability of the observer to transient effects such as glare or flashblindness, and will obscure a larger part of the observer's field of vision. Definitions for the transient visual effects of glare, flashblindness, and afterimages are given below:

Glare: a reduction or total loss of visibility, such as that produced by the sun, searchlights, or headlights. These visual effects last only as long as the light is actually present affecting the individual's field of vision. Exposure to continuous wave or rapidly pulsed visible light can produce glare and can interfere with vision even at radiant powers well below those that produce permanent eye damage.

Flashblindness: inability to detect or resolve a visual target following exposure to a bright light, similar to that produced by flashbulbs. It can occur at irradiance levels well below those that cause eye damage. Visible light can produce a lingering yet temporary visual loss associated with spatially localized after-effects. This impairment is transitory, depending upon the light source exposure level and time, the visual task, the ambient lighting, the observer's level of adaptation, and the brightness of the visual target.

Afterimage: perception of light, dark, or colored spots after exposure to a bright light. Small afterimages, through which one can see, may persist for several minutes or even hours.

The irradiance or radiant exposure at the retina for a light source is also a function of pupil size since the area of the pupil determines how much light enters the eye. The average pupil is 2-3 mm in diameter for normal daylight viewing and will dilate to around 7 mm in a dark environment. Generally speaking, the dark adapted eye will allow 10 times more light into the eye during exposure than the light adapted eye. This makes personnel at night, already confronted with low contrast targets, the most susceptible to the adverse effects of overexposure to light.

To protect individuals from the hazards of laser and broadband light exposure, the American National Standards Institute and other international safety organizations use maximum permissible exposure (MPE), which is defined as that level of light radiation to which a person may be exposed without suffering any adverse biological effects. However, the MPE does not take into account transient effects such as glare and flashblindness. The safety standards and MPE were established based on experimentally determined threshold levels for optically-induced damage to biological tissues. MPE limits are expressed in terms of irradiance ($W/cm^2$) or radiant exposure ($J/cm^2$) and are a function of wavelength and exposure duration. It is important in the development of a less-than-lethal technology to stay well below irradiance damage thresholds, taking into consideration the worst-case observer-source geometry and the largest pupil diameter and stare time.

Adams (U.S. Pat. No. 5,222,798) describes a self contained, self powered, bright light source in a strong case having a transparent dome that is thrown or fired into position. Once activated, the light source may not be readily deactivated and will shine sufficiently bright so as to be temporarily blinding to the direct view of any human who is close enough to the light source to touch it. Minovitch (U.S. Pat. No. 5,234,894) describes a flashlight type device with energy storage capacitors and a flashtube that can create a high intensity light to temporarily blind an assailant at a distance. The flash is focused by a reflector to form a concentrated beamed light flash which is aimed at an assailant's head. Ripingill (U.S. Pat. No. 6,065,404) describes a simulated grenade that is meant for simulating a pyrotechnic fragmentation grenade and is not intended to visually disable personnel in the vicinity of its blast. A plurality of transducers such as infrared LED's, acoustic transducers or RF transducers are located in the core for emitting signals detectable by a plurality of sensors worn by a player within a predetermined proximity of the simulated grenade.

Tocci (U.S. Pat. No. 6,190,022) describes a self contained non-lethal security device for providing an optimally effective and eye-safe beam for use as a high brightness visual countermeasure. The device has one or more wavelengths of laser or LED light in a continuous or flicker mode in order to provide a glare or flashblinding visual effect. The device is apparently not intended to be used as a projectile, and has no provision for sound output nor extending the effective source size of the light. In addition, Tocci teaches the use of LED devices that are encapsulated in plastic and soldered to a printed circuit board, just as a normal electronic component might be. The size of the commercial LED packaging limits the density of LEDs that can be put on a single circuit board. In addition, the commercial LED package has poor thermal conductivity, limiting LED radiant output. The limited density and poor thermal characteristics of the Tocci design limit the realizable radiant output to values less than those required to produce any visual effect in an adversary.

Brown (U.S. Pat. No. 6,799,868) describes a laser flashlight that employs an emitter disposed within a housing for emitting a coherent light beam having a gaussian spatial profile along an optical axis toward the exit face of the housing. An optical system disposed within the housing intermediate to the emitter and the exit face of the housing includes a laser element pumped by the emitter, a frequency/wavelength converter, and a resonator, to form the coherent light into a laser beam. A beam expander receives the laser beam, disperses the laser beam, and transmits the dispersed laser beam from the light emitting end of the housing into the ambient environment. The device does not support the visual impairment of adversaries over a broad range of angles, must be aimed and has no capability of being thrown or projected.

The limitations of the currently available less-than-lethal optical devices demonstrate that new systems are needed for use in situations where the laser dazzler and stun grenade are inappropriate, ineffective, or lead to potentially hazardous situations for either the deploying person or to the adversaries. What is needed is a non-lethal optical device using a non-coherent source of light, such as arrays of light-emitting diodes (LEDs) or a high-pressure discharge lamp, that can create a disorienting or vision-obscuring glare in adversaries without the above-mentioned issues of eye safety or ignition of flammable materials. Such devices are also needed for recreational purposes to be used in simulated military or police activities.

SUMMARY OF THE INVENTION

The present invention is a non-lethal, non-pyrotechnic projectile that produces a high-intensity light and may produce a piercing sound capable of disorienting adversaries. The projectile may produce light preferentially in spectral ranges where humans have the greatest visual response to optical radiation. The projectile may be small enough to be carried and tossed by hand, powered by internal batteries, and activated by a recessed pushbutton in the device's housing.

The projectile's light source may be comprised of one or more modules each containing an array of light-emitting diodes (LEDs) operating at a center wavelength in the range from 350 nm to 980 nm, but preferably from 510 nm to 550 nm (an array may consist of one light-emitting diode). The light source modules in this embodiment combine the functions of electrical switching of the supply current, delivery of current to the plurality of LEDs, and thermal conduction of waste heat to an appropriate sink, all within a compact mechanical package. The light source modules are specifically engineered to provide an optimum areal density of LED emitters and good thermal conductivity to an adequate heat sink. To achieve this, one or more unpackaged LED dice are bonded directly to an electrical substrate with high thermal conductivity, and contain a wire bond to another electrode to complete the LEDs electrical circuit. The electrical substrate is subsequently attached to a heat sink with a very low thermal resistance bond. With this practice, large amounts of radiant power can be emitted by the LEDs without damage or wavelength shift due to the temperature increase in the LED junction. In addition to good thermal control, the use of bare LED dice increases efficiency of the light output, and projects light over a wider angular distribution than if commercial LED packaging were being used.

The absence of the plastic lens found on most commercial LEDs allows the LED die to emit in a cone with 120° full angle. Therefore a single light generation module populated with LED dice also has an emission full angle of approximately 120°. This angle is sufficiently large that two to three light generation modules are sufficient to completely illuminate all parts of a room, providing disorienting effects to all occupants of the room.

Preferably, LED dice are bonded to the electrical substrate with a packing density of from 1-50 per square centimeter. Use of a higher LED packing density increases the radiant flux from each light generation module, but with corresponding higher battery current and thermal dissipation. For a general LED, emitting at some wavelength with some efficacy, there is a critical packing density beyond which there becomes no further visual effect. At this critical packing density, the retina of an adversary viewing the light generation module becomes saturated—additional light produces no additional visual effect. Thus the preferred LED density should be close to the critical packing density, and is a function of the particular LED being used and its emission characteristics.

The projectile's light source may be comprised of one or more modules each containing an array of light-emitting diodes (LEDs) operating at different center wavelengths that span some spectral range, in order to create the perception of a white light source.

The projectile's light source may be comprised of one or more modules each containing an array of light-emitting diodes (LEDs) operating at the same center wavelength, but with different modules having distinct operating center wavelengths. In some instances, alternating flashing lights of different colors can produce anxiety or confusion in an observer, thus aiding in incapacitation of adversaries.

The projectile's light source may, alternatively, be comprised of one or a plurality of modules each containing a high-pressure discharge lamp, such as a xenon flashlamp. Because the spectral output of such flashlamps has poor overlap with the optimal part of the human spectral responsivity, this embodiment also employs a wavelength conversion means to transfer portions of the flashlamp output power from regions of poor human visual spectral efficiency to the spectral region around 555 nm, where human spectral responsivity is maximum for a light-adapted eye. In a variation of this embodiment, the wavelength conversion means transfers portions of the flashlamp output power from regions of poor human visual spectral efficiency to spectral regions around 365 nm, where the human lens fluorescense produces veiling glare on the observer's retina. The wavelength conversion is accomplished by one or more organic dyes, preferably dissolved in a polymer layer surrounding the discharge lamp. The organic dyes are specifically engineered for use in tunable lasers, but used in the non-lethal projectile to selectively absorb radiant energy from the discharge lamp at wavelengths where human visual responsivity is low, and then re-emit the energy at more visually-favorable wavelengths.

The projectile may contain a means for dispersal of a cloud of diffusely reflecting material, the function of which is to increase the effective size of the light generator source. It is well known that obstruction of an adversary's field of vision is increased as the size of the light source is increased. A variant of this embodiment contains a means for inflating a thin diffusely reflecting membrane, from which light from the light generation source reflects, causing an increase in the effective size of the light source.

The projectile may contain a sound generator that emits a loud, predetermined audio waveform that is annoying, disruptive, and/or disorienting to potential adversaries. In this embodiment, the sound generator is constructed from a piezoelectric bimorph disc which is excited by the voltage from a step-up transformer, which is in turn driven by a bipolar or field-effect transistor connected to the projectile's control circuitry.

The projectile may contain a sound generator that produces sound by passing compressed gas across or through a resonating structure. In this embodiment, an electrical signal is used to actuate a gas valve that allows gas to expand from a small container of compressed gas. Preferably, gases which liquefy at moderate pressures, such as $CO_2$ or $N_2O$ are used to obtain a large volume of gaseous product in a small volume container.

The projectile may contain control circuitry consisting primarily of a microcontroller and a plurality of software programs connected to the light and sound generation modules. The software programs determine the activation, duration, and sequencing of each individual light generator and sound generator, and also determines the audio waveform of the latter. Different software programs can be selected by the deploying personnel dependent upon the scenario of use, e.g. day or night, training or actual, long duration operation or short.

The projectile and its components may be housed in a rugged housing that provides mounting fixtures and protection to internal components. In this embodiment, the projectile can be launched by hand or by mechanical or pyrotechnic propulsion means to cause the projectile to travel a desired distance. In this embodiment, there is a selectable delay time built into the optical and audio sequencing of the software programs to compensate for the projectile flight time between activation and arrival at the target. The rugged case provides for protection of internal components, and is transparent in the spatial location of each light generating module to the part of the electromagnetic spectrum emitted by the light generating module. Typical shapes that facilitate hand throwing or launching include cylinders, spheres, and ovoids.

The components of the projectile may be housed in a case whose shape and mass distribution ensures that the projectile will come to rest in a desired orientation, the purpose of which is to optimize the spatial distribution of the generated light and sound. Such a case may take the approximate form of a prolate spheroid, with only two principal orientations possible on a level surface. In a variant of this embodiment, the case of the projectile may take a tetrahedral or pyramidal shape, and may have hinged appendages that unfold after the projectile has landed that force the case into an orientation that optimizes the spatial distribution of generated light and sound. In this embodiment, the appendages would be preloaded with springs, and would unfold when unlatched either by the shock of landing or electrically, after a desired time delay.

Radio-frequency transceivers connected to the projectile's control circuitry may allow a plurality of projectiles in the same general vicinity of one another to synchronize their respective software programs, and thus to activate their respective light generation and sound generation modules in such a fashion that the collective effect is optimized for disorientation or confusion of adversaries. One aspect of this embodiment is that deploying personnel may be provided with protective gear (eyewear, acoustic attenuators, etc.) that also synchronize with the radio-frequency signals, and so provide a measure of protection against the effects of the projectiles.

A non-lethal projectile that is capable of producing flash-blindness or glare in an adversary has value for law-enforcement operations, hostage-rescue operations, military operations, prison inmate control applications, and in surprise raids on alleged criminals or criminal activity. It follows that, because the projectile can be used safely against any personnel, the projectile has application in the training of law enforcement, special operations, and military personnel, without any danger of damage to human eyesight, hearing, or training infrastructure. Similarly, the non-lethal projectile has direct application in simulated warfare for entertainment, or paintball games. In paintball, lethal weapons have simulants that fire small frangible pellets containing a colored paint or other marker. Participants in the game are "killed" when marked by the paint, and must immediately leave the game. Larger-caliber weapons are simulated by firing spongy plastic projectiles at vehicles or buildings. In this case, in the absence of a paint marker, a field judge or referee will typically decide when structural damage or player casualties result. There is a large and growing market for guns, rifles, and other paraphernalia associated with the game of paintball. The non-lethal projectile is an ideal addition to the paintball player's arsenal for all of the same reasons that it is of use to law enforcement and military users. A paintball player could use the non-lethal projectile to temporarily disorient or confuse simulated adversaries in an enclosed environment, providing additional surprise and time to fire paint-filled pellets at the occupants. Alternately, the non-lethal projectile could be used as a throwable grenade simulant, in which case a judge or referee would rule players out of the game if within a predetermined radius of the projectile when it was activated. A paint-filled balloon is presently used as a grenade simulant, but does not have the range or reuseability that the present invention would provide. In another application, the non-lethal projectile could be used as a simulated bomb or mine, which could be "defused" or rendered harmless by actuating a plurality of pushbuttons in a correct sequence. Unless the sequence entered is one of the (possibly multiple) correct sequences, the device activates immediately, or after a time delay. A judge or referee would then determine the simulated lethality of the device to players, nearby vehicles, or buildings. Variations of this device might contain motion sensors, proximity sensors, or acoustic sensors that could be used to activate the device.

It should be clear to one skilled in the art of engineering that the various aspects and characteristics of the above-described embodiments can be combined in different permutations and physical configurations, each of which still has a disorienting and confusing effect on an adversary, thus being a variant of the subject invention.

DETAILED DESCRIPTION OF THE INVENTION

Figure 1:
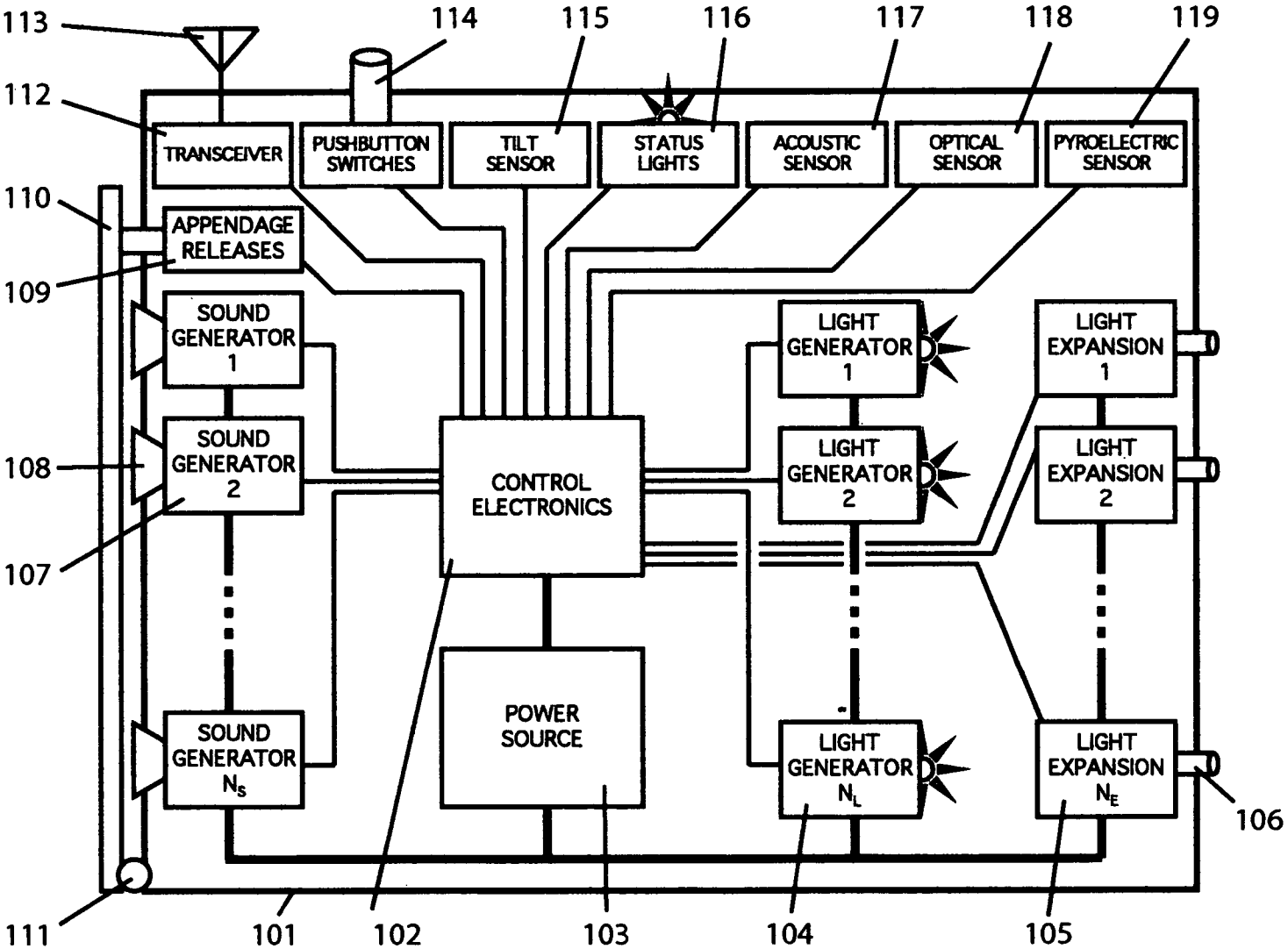
FIG. 1 is a block diagram illustrating the relationship of the various components of the non-lethal projectile.

Referring to FIG. 1, components of a preferred embodiment of a non-lethal projectile, which is self-contained in housing 101, is illustrated. Internal power source 103, typically a battery; a plurality of light generating modules 104, each module which optionally has an associated light expansion module 105 with an orifice 106; and a plurality of sound generating modules, 107, each sound-generating module with a director 108 to direct the acoustic emissions are shown. Communications transceiver 112 with antenna 113 is also contained within the housing and may be used to facilitate synchronization of the light and sound sequencing among multiple projectiles. Optionally attached to the housing are hinged appendages 110, with an associated appendage release mechanisms 109, which are used to force the projectile into a specific orientation after deployment. Also within the housing are control electronics 102, attached to which are switches 114, which may be push-button switches, (herein designated operator switch) to initiate operation of the device and a tilt sensor 115 to allow the control electronics to determine the orientation of the projectile.

The tilt sensor, communications transceiver 112, acoustic sensor 117, optical sensor 118, and pyroelectric sensor 119 can be used together in any combination or individually to detect a remote command or an external change in environment which, when sent to the control electronics, can trigger activation of the device. The sensors could detect, for examples, a communication message, a change in orientation, an acceleration or vibration, a specific level or frequency of sound, the presence (or absence) of visible or infrared light or an amplitude-modulated coded message, or a change in ambient long-wave infrared radiation due to motion of a warm object.

The control electronics may activate one or more of the: light generating modules, sound generating modules, light expansion modules, communications transceiver, and appendage releases, at the desired time after deployment, and in the desired sequence, for the desired duration. The control electronics optionally enforce a lock-out state, during which the projectile cannot be re-armed or triggered unless a preset sequence of button pushes is executed. A status light 116 may be provided to give optical feedback to a user with regard to battery charge state and operational mode.

An embodiment of the invention so equipped will effectively function as a non-pyrotechnic stun projectile that can be thrown or projected into a room or in the vicinity of opposing personnel to disorient, confuse, or delay reaction in the opposing personnel.

Figure 2A:
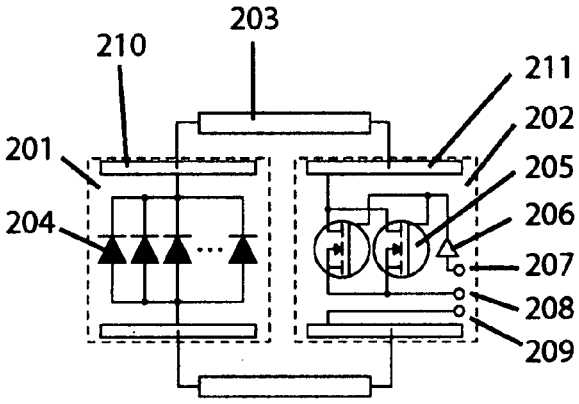
FIG. 2A is a schematic of a light generation module.

Referring to FIG. 2A, a light-generation module is shown in schematic form. A light-generation module may generate visible light at one or more wavelengths with one of the wavelengths preferentially centered close to the peak human eye sensitivity (555 nm). The light may be emitted from light emitting diodes (LEDs) 204 attached to substrate 201 with at least some of the LEDs operating at center wavelengths between 500 and 555 nm. The light-generator substrate has electrically conductive pads 210 on opposing sides to allow a path for current to enter and exit the substrate. The light generator brightness is preferably at least 100,000 cd/m$^2$ so as to produce either veiling glare or flashblindness in opposing personnel, depending on the personnel's distance from the projectile, ambient illuminance level, and target contrast. The LEDs in a light generation module are switched to and from the emitting state by passing electrical current through all LEDs in a parallel circuit configuration.

The switch is comprised of printed circuit board 202 with conductive pads 211 to allow the flow of electrical current onto and from the printed circuit board. The printed circuit board has one or more active semiconductor elements (e.g. field-effect transistors) 205 to accomplish the current switching. An amplifier 206 may be provided to speed the switching transition. In a preferred embodiment, current from a power source enters the switch circuit through power bus 209. When the semiconductor elements are switched into a conductive state to complete the electrical circuit in the light generation module, current flows into the switch printed circuit board, passes to the LED printed circuit board through conductive interconnects 203, then passes through individual LEDs, flows back to the switch printed circuit board via another conductive interconnect and finally through the semiconductor switch back to power bus 208. Control of the state of the semiconductor switch is provided by gate signal 207.

Figure 2B:
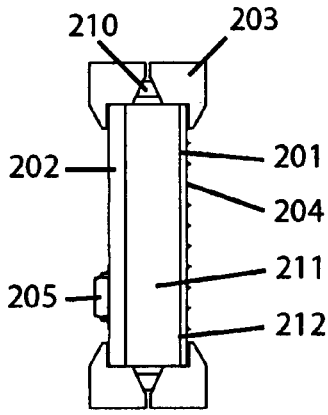
FIG. 2B is a side vide of a light generator module components.
Figure 2D:
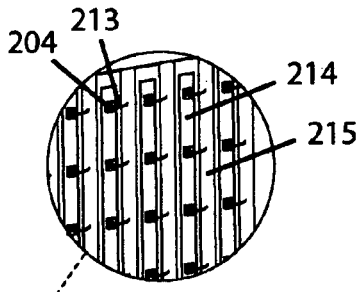
FIG. 2D is a view of the individual light emitting diodes (LEDs) of FIG. 2C.
Figure 2C:
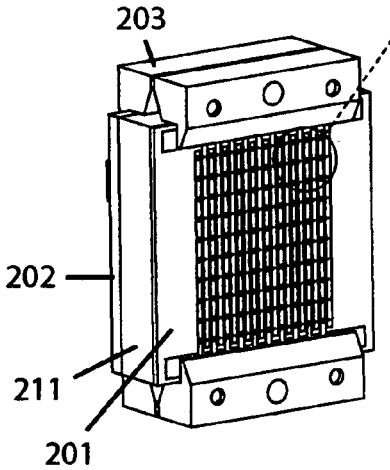
FIG. 2C is a front view of a light generator module.
Figure 2E:
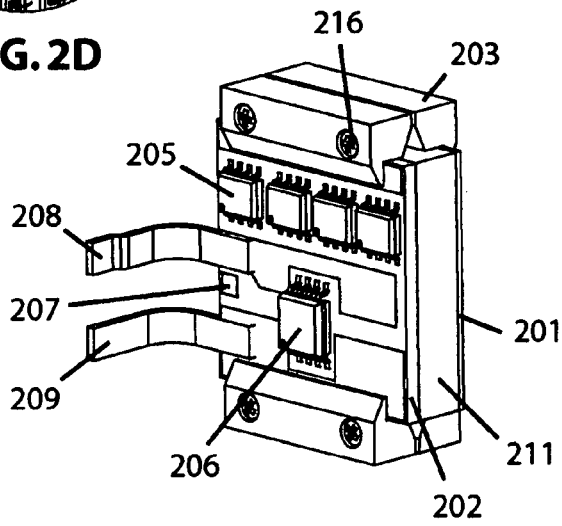
FIG. 2E is a back view of a light generator module.

In a preferred embodiment, illustrated in FIG. 2D, individual LEDs (Cree X-Thin) 204 are obtained from the manufacturer in die form, and are bonded directly to gold (Au) traces 214 on the light generator circuit board with a copper-gold (CuAu) eutectic to form the anode connection. The LED cathode connection is made by a wire bond 213 from the top surface of the LED die to the adjacent Au circuit trace 215. The wire is connected to the Au circuit trace by a bond produced by an ultrasonic wire-bond machine.

Preferably the light generator circuit board is made of a high-conductivity material such as aluminum nitride (AlN), with gold traces patterned on the surface for high electrical conductivity, as may be obtained from Kyocera Corp. Preferably all of the LED die are wired in parallel. The AlN circuit board is preferably 0.3 to 1 mm thick and the gold traces are 0.5 to 1 mm wide and 75-200 micrometers thick in order to conduct a current in excess of 1 amperes/LED without a significant voltage drop.

In the side view, FIG. 2B, is shown the stacked construction of the light generator module components. The light generator printed circuit board 201 with bonded LEDs 204 is attached to one side of a heat sink 211. Preferably the heat sink is made of a material like copper (Cu) which has a high thermal conductivity and a high heat capacity per unit volume. Preferably, in between the light generator circuit board and the heat sink is placed a thin layer of heat-conducting compound (Omega Engineering, Inc.) 212 to aid in the transfer of thermal energy from the LEDs into the heat sink. On the reverse side of the heat sink, the switch printed circuit board 202, with active components 205 is placed so that it can also dissipate its heat into the heat sink. Electrically conductive interconnects 203, in the form of clamps, preferably made from copper or aluminum, are used to hold the stacked arrangement together into an integrated light generating module. Views 2C and 2E illustrate the dimensional similarity of the light generation module's heat sink 211, LED printed circuit board 201, switch circuit board 202, and conductive clamps 203. Clamp adjustment screws 216 are used to ensure a good mechanical and electrical clamping of the various components. The positive 209 and negative 208 power bus connections are shown attached to their respective pads on the switch circuit board. The power buses are preferably thick copper conductors capable of conducting in excess of 50 amperes without appreciable voltage drop or heating, and are soldered to the switch circuit board. The gate signal to the semiconductor switches (Internation Rectifier HexFET) is preferably a simple wire soldered to the appropriate pad 207 on the switch circuit board.

The light generator module size can be between 1 square centimeter to larger than 400 square centimeters, with larger source sizes obscuring more of the opponent's visual angle. Preferably, the projectile includes a number of discrete light generators spaced over an area that is as large as practical, consistent with the shape, size, and method of delivery of the projectile. One preferred embodiment uses 8 light generator modules, each with 100 LEDs constructed from InGaN semiconductor material on a SiC base (Cree X-Thin LED dice), emitting at a center wavelength of 520 nm.

FIG. 3 illustrates an embodiment of a light-generator module that uses a flashlamp instead of multiple LEDs. A schematic of the flashlamp circuit (FIG. 3A), an isometric view (FIG. 3B) of the module, a top view of the module (FIG. 3C), and a graph (FIG. 3D) illustrating the spectral energy transfer are included.

Figure 3A:
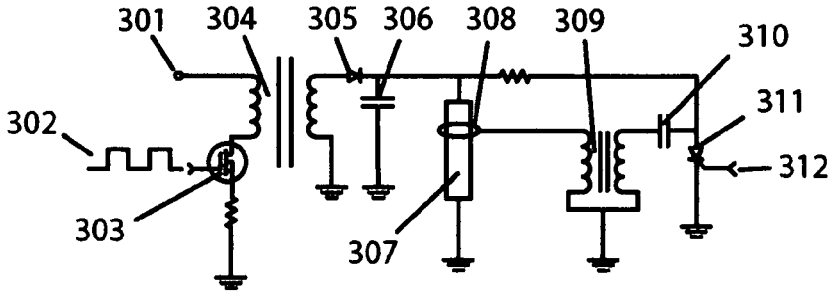
FIG. 3A is a schematic of a flashlamp circuit.

Referring to FIG. 3A, the flashlamp light-generator module is electrically connected to the positive terminal of the battery at the V+ connector, 301. The negative terminal of the battery is connected to circuit ground. When gated by a sequence of voltage pulses 302 from the control electronics, MOS transistor 303 enters a conductive state, allowing current to pass from the battery, through the primary of transformer 304 and thence to ground. The secondary winding of the transformer is oriented such that rectifier 305 is reverse-biased during the time that the primary current is increasing. Since no current flows in the secondary, the primary current causes magnetic energy to be stored in the transformer. When the MOS transistor is gated off, the primary current ceases to flow, and the stored magnetic energy causes a voltage to be generated in the transformer secondary circuit that now forward-biases the rectifier. The secondary voltage is stepped-up by the primary-to-secondary winding ratio of the transformer. Whenever the secondary voltage is larger than the voltage on discharge capacitor 306 plus the forward voltage drop of the rectifier, current flows through the rectifier and into the discharge capacitor. By repetitively gating the MOS transistor in this cycle, called a flyback cycle, energy is transferred from the battery into stored electrical charge in the discharge capacitor.

Discharge capacitor 306 (Cornell-Dubilier 7P photoflash or equivalent) is connected directly to the anode of flashlamp 307 (Mouser Corp. 36-FT050). As long as the discharge capacitor voltage remains lower than the breakdown voltage of the flashlamp, the latter remains an open circuit. One method to pulse the flashlamp is to increase the voltage of the discharge capacitor with flyback cycles until the gas in the flashlamp breaks down, causing an avalanche of current as the stored energy in the discharge capacitor is converted to light and heat in the ensuing plasma inside the flashlamp. This method has the disadvantage that the timing of the flashlamp pulse and ensuing optical pulse is not controlled accurately, causing an erratic and uncontrollable pulse repetition frequency.

A preferred method of initiating the flashlamp pulse is to ionize a small amount of the internal gas of the flashlamp with a high-voltage, low-current trigger pulse. Trigger capacitor 310 is charged to the same voltage as the discharge capacitor. Generally the trigger capacitor is much smaller than the discharge capacitor, and thus holds much less stored electrical energy. Application of a voltage pulse to the trigger terminal 312 of a SCR(ON Semiconductor MCR25) 311 causes it to quickly conduct current, discharging the trigger capacitor to the negative terminal of the battery. The trigger capacitor discharge current flows through the primary winding of trigger transformer 309 (Xicon 422-2310). The large turns ratio and polarity of the trigger transformer cause a large positive voltage to be generated at the trigger transformer secondary, which is applied to a trigger electrode 308 affixed or painted onto the envelope of the flashlamp close to the cathode end of the flashlamp. The high electric field thus induced between the trigger electrode and the cathode of the flashlamp exceeds the breakdown voltage of the gas inside the flashlamp. A small streamer of ions and electrons is thus produced in the flashlamp, which avalanches rapidly (less than 1 nanosecond) into a full discharge as the stored energy in the discharge capacitor flows through the flashlamp.

Figure 3B:
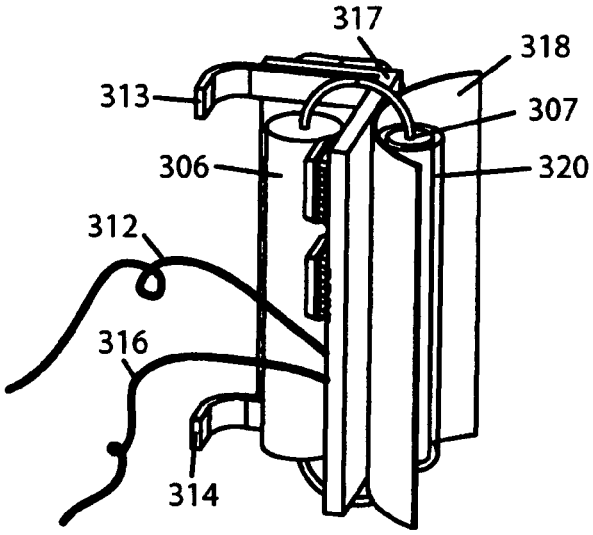
FIG. 3B is an isometric view of a flashlamp module.
Figure 3C:
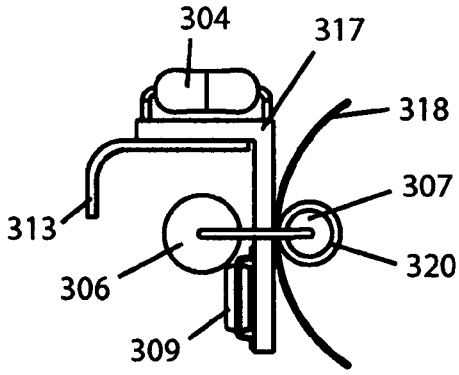
FIG. 3C is a top view of a flashlamp module.
Figure 3D:
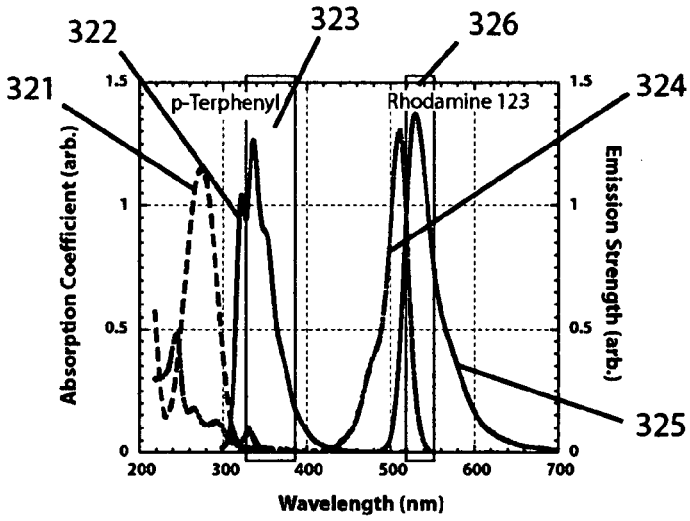
FIG. 3D is a graph illustrating the spectral energy transfer.

In a preferred embodiment of the flashlamp light generator module, as shown in FIGS. 3B and 3C, the electronic components are attached to one or more printed circuit boards 317. Of these components, the discharge capacitor 306 and the flashlamp 307 are the largest. It is advantageous for light efficiency reasons to place a reflector 318 between the flashlamp and the circuit board. The flashlamp is surrounded by a cylindrical spectral transfer material 320, which serves to increase the amount of light in the desired spectral band of the eye, and also to physically hold the axis of the flashlamp at the focal line of the reflector. Other parts of the circuit board contain the positive power terminal 313, the negative power terminal 314, the MOS transistor gate signal connection 312, and the trigger pulse connection 316.

Normally, the spectral composition of the light from a flashlamp can be described as similar to that from a blackbody radiator at a high temperature, typically 8000K-10000K. The flashlamp thus outputs light from the ultraviolet, through the visible, and into the infrared parts of the spectrum. In accordance with earlier discussion, for the purposes of startling, disorienting, or causing optical artifacts in the vision of adversaries, it is desirable to have light primarily in the spectral region from 510 nm to 555 nm. The flashlamp is very efficient at converting stored electrical energy from a capacitor into electromagnetic wave energy but is inefficient at producing light with a spectrally narrow profile as required for the projectile application. With the addition of spectral transfer materials either onto the envelope of the flashlamp or by other means surrounding the flashlamp envelope, light energy can be transferred from undesirable spectral regions to those more favorable for the visual function of disorientation or startling adversaries. For example, classes of fluorescent dyes such as xanthenes, coumarins, and fluoresceins are instances of materials that absorb light energy in one spectral region and re-emit, via fluorescence, in a different region. These dyes are specifically engineered for use in tunable dye lasers, where an intense light source is used to energize, or "pump" a dye, subsequently causing it to emit light at a longer wavelength than the pumping light source. Dyes are commercially available for almost any desired range of emission and absorption wavelengths. In particular, the dye p-terphenyl (available from Exciton Corp.) absorbs strongly between 250 nm and 300 μm, corresponding to the absorption curve 321 in FIG. 3D. The dye re-emits the energy primarily between 320 nm and 360 nm with relative intensity shown in emission curve 322. Much of this emission is in the spectral region 323 where lens fluorescence can obscure human vision. Similarly, the dye Rhodamine 123 (Exciton Corp.) absorbs strongly at wavelengths between 480 nm and 515 nm and weakly between 230 nm and 280 nm (absorption curve 324), re-emitting the energy between 520 nm and 610 nm (emission curve 325), in the spectral region 326, where the human retina's visual sensitivity is highest. Thus spectral transfer materials can increase the visual efficacy of the flashlamp light module by transferring otherwise useless optical energy into spectral bands where the human visual system possesses greater sensitivity.

As received from the supplier, the spectral transfer dyes are normally in powder form. When dissolved, the liquid solution is capable of spectral transfer. Typical solvents for dye lasers are water, alcohols, p-dioxane, or dimethyl sulfoxide, depending upon the molecular structure of the dye. For the projectile, a preferred embodiment is the use of a mixture of p-terphenyl and Rhodamine 123 dyes, dissolved in methyl methacrylate with a concentration of approximately 0.001 moles per liter. This dye concentration is sufficient to provide an absorption length of about 40 $cm^{-1}$, ensuring almost total absorption of discharge lamp radiation within the dye's spectral absorption regions for a thickness of a few mm. The methyl methacrylate/dye solution is then poured into a hollow cylindrical mold and polymerized to form a solid acrylic piece that surrounds the discharge lamp and provides spectral energy transfer. Thicknesses of 1-5 mm are preferred for the spectral conversion material. Solution in alternate polymers such as polystyrene, polycarbonate, and polyethylene can be used as long as compatibility and solubility of the desired laser dyes with the monomer is verified.

Figure 4:
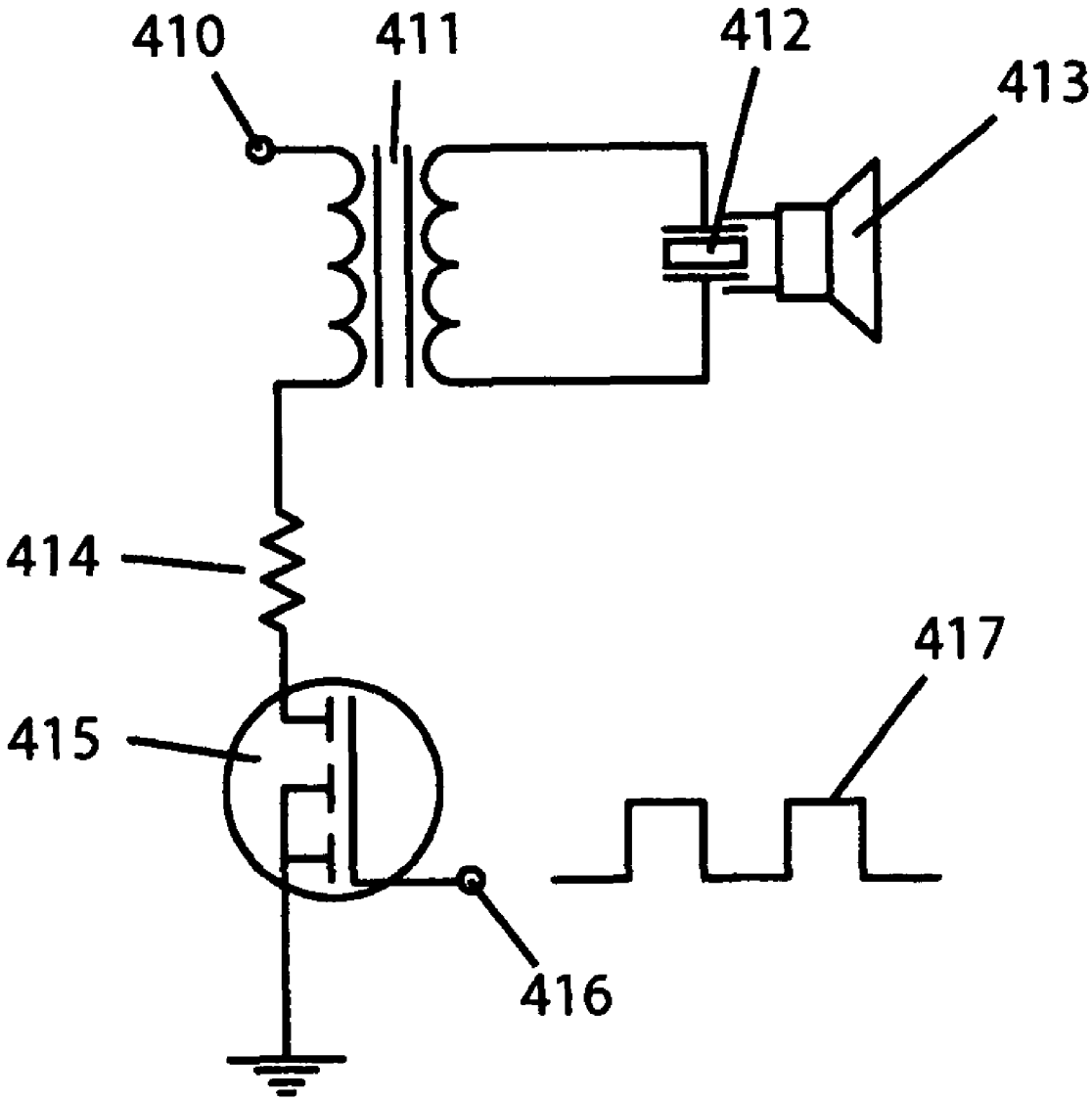
FIG. 4 is a schematic diagram of a sound generation module.

FIG. 4 illustrates a preferred embodiment of an electrical schematic for a sound generator module. The V+ terminal 410 is attached to the main power source of the projectile, usually a battery. An audio waveform 417 supplied by the control electronics is input to the gate 416 of a MOS transistor 415. The audio waveform causes the transistor to change its conductivity, and thus change the current flow through the primary winding of transformer 411. Current-limiting resistor 414 prevents damage to the transformer and the transistor. The changing current in the transformer induces a voltage in the secondary winding of the transformer, which is applied across a piezoelectric bimorph membrane 412 (Kyocera Corp.). The membrane deforms according to the voltage present across its terminals, and can cause pressure waves to be generated in the surrounding air. A suitably tuned acoustic resonator and director 413 is used to enhance the intensity of the acoustic emission between frequencies of approximately 2500 Hz to 3500 Hz. By changing the frequency of the waveform applied to the gate of the transistor, different acoustic pitches can be generated.

Figure 5:
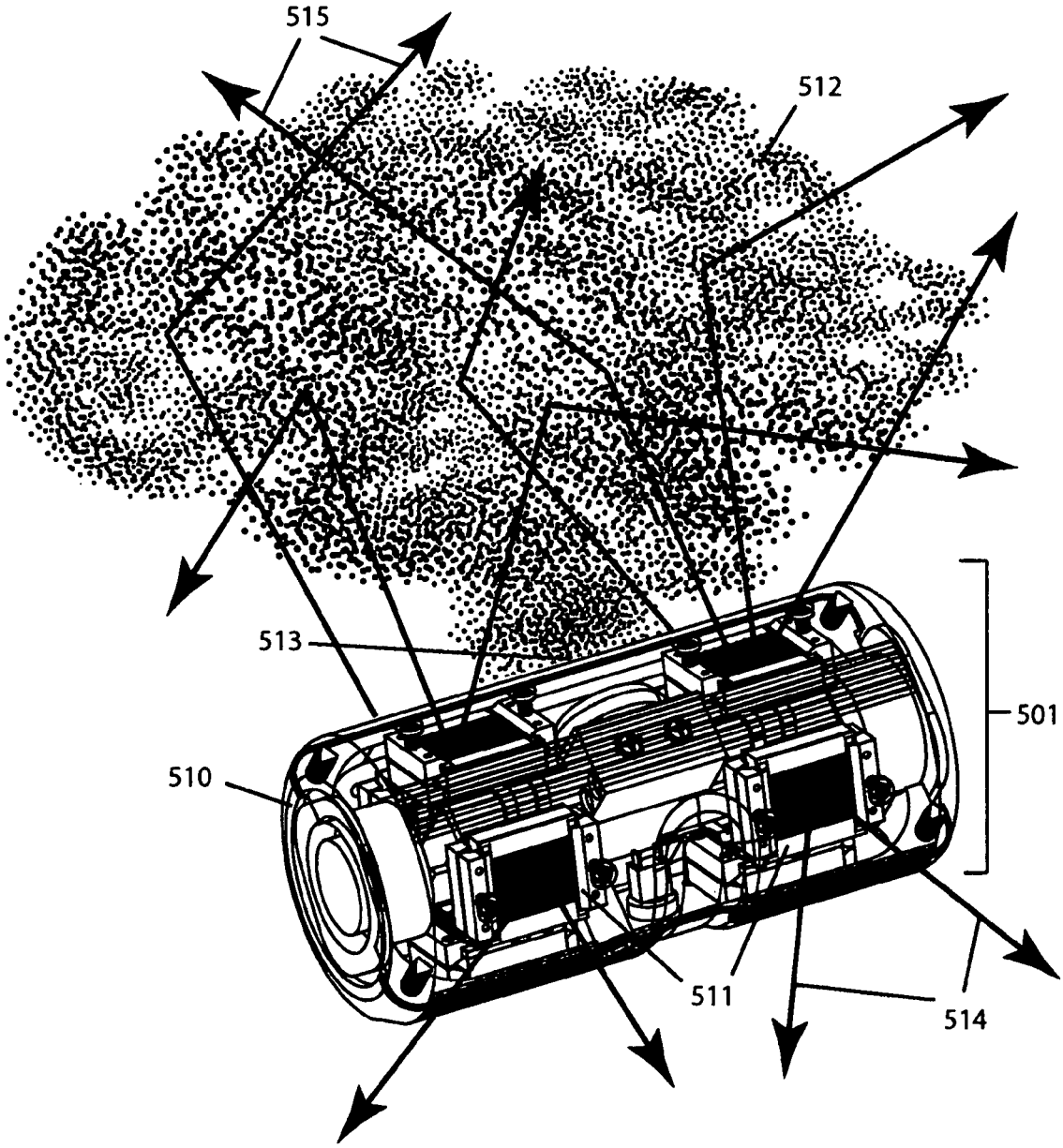
FIG. 5 is a diagram illustrating the dispersal of a cloud of diffusely reflecting powder to increase the light generator source size.

FIG. 5 shows the operation of the projectile with a light-expansion module employing a diffusing powder. Housing 501, containing a plurality of emitting light generation modules 511, disperses a reflective powder or aerosol into a localized cloud 512 through a plurality of dispersal nozzles 513.

Light rays 515 generated by the light generation modules are reflected and scattered from the powder to form a larger effective optical source, from the perspective of a viewer. Other light rays 514 do not encounter the reflective powder or aerosol, and are not scattered. A larger apparent optical source with a high-enough visual radiance will obscure a much larger fraction of a viewer's angular field of vision than a smaller source with equivalent radiance, increasing the effectiveness of the distraction, glare, or flashblinding effect. Preferably, highly reflective powders like barium sulfate or magnesium sulfate (ST Company, Ltd.) are used to make the diffuse cloud. Such powders are inert, inexpensive, light, and can be ground to the small sizes (0.5-5.0 micrometers) required for good dispersal. Other materials such as calcium carbonate, kaolin, or talc can be used with almost equal effectiveness. In another preferred embodiment of the light expansion material, specularly-reflecting materials such as glitter are used to reflect the light from the light generating modules and form an effectively larger-sized source. In addition, a fine aerosol or smoke may be used to form a diffusely-reflecting cloud.

In a preferred embodiment, the diffusely-reflecting material (powder, glitter, liquid for aerosol) is packaged in a small container within the projectile's housing, with one package of material per dispersal nozzle. A source of compressed gas (liquid $CO_2$ or $N_2O$) is also attached to the dispersal nozzle with an electrically operated valve. On activation of the projectile's program sequence, the valve is opened, and the compressed gas escapes, aspirating the diffuse material from the package and ejecting it into the region external to the dispersal nozzle. This action may occur for approximately three seconds, until the compressed gas supply is exhausted.

Figure 6:
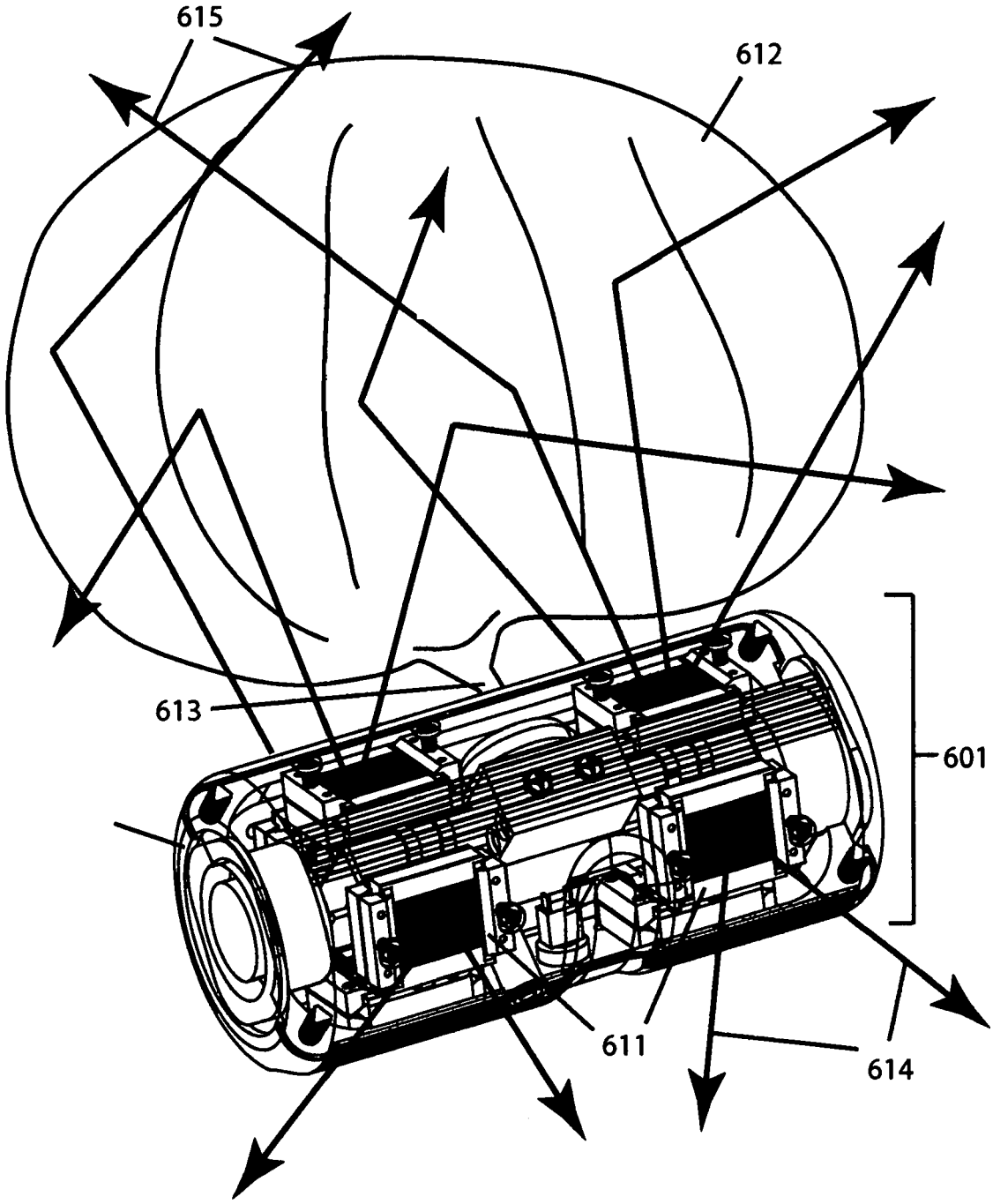
FIG. 6 is a diagram illustrating the inflation of a diffusely reflecting membrane to increase the light generator source size.

FIG. 6 shows the operation of the projectile with the light expansion module employing an inflatable diffuser. Housing 601, with a plurality of emitting light generation modules 611, inflates one or more diffusers 612 through a plurality of diffuser nozzles 613. Light rays 615 generated by the light generation modules are reflected and scattered from the surface of the diffuser to form a larger effective optical source, from the perspective of a viewer, with a correspondingly larger field of visual obscuration of an adversary. Diffusers may be constructed from a variety of materials, with the key characteristics being flexibility and a diffusely reflecting surface finish. Mylar (thin polyester) is one material that is suitable for a diffuser, and latex rubber is another. The diffuser is typically stored in a compartment on the side of the projectile with a flush-mount hinged cover. Upon activation of the projectile, gas (preferably $CO_2$ or $N_2O$) from a cartridge is released, inflating the diffuser. The increase in volume of the diffuser causes it to force the hinged cover open, allowing the diffuser to expand to its full size adjacent to the projectile. In a preferred embodiment, a projectile incorporates a single inflatable diffuser, Upon activation, the projectile's control circuitry sends a signal to an electrically-controlled gas valve, which releases the entire contents of a small $CO_2$ cartridge (approximately 100 g). The released gas may be directed into the inflatable diffuser, which expands to a volume of about 50 liters, or into a spherical shape with a diameter of approximately 40 cm. In another embodiment of the projectile, one or more inflatable diffusers can be used instead of appendages to force the projectile, post-landing, into an orientation that is advantageous for delivering light and/or sound to an adversary.

Figure 7:
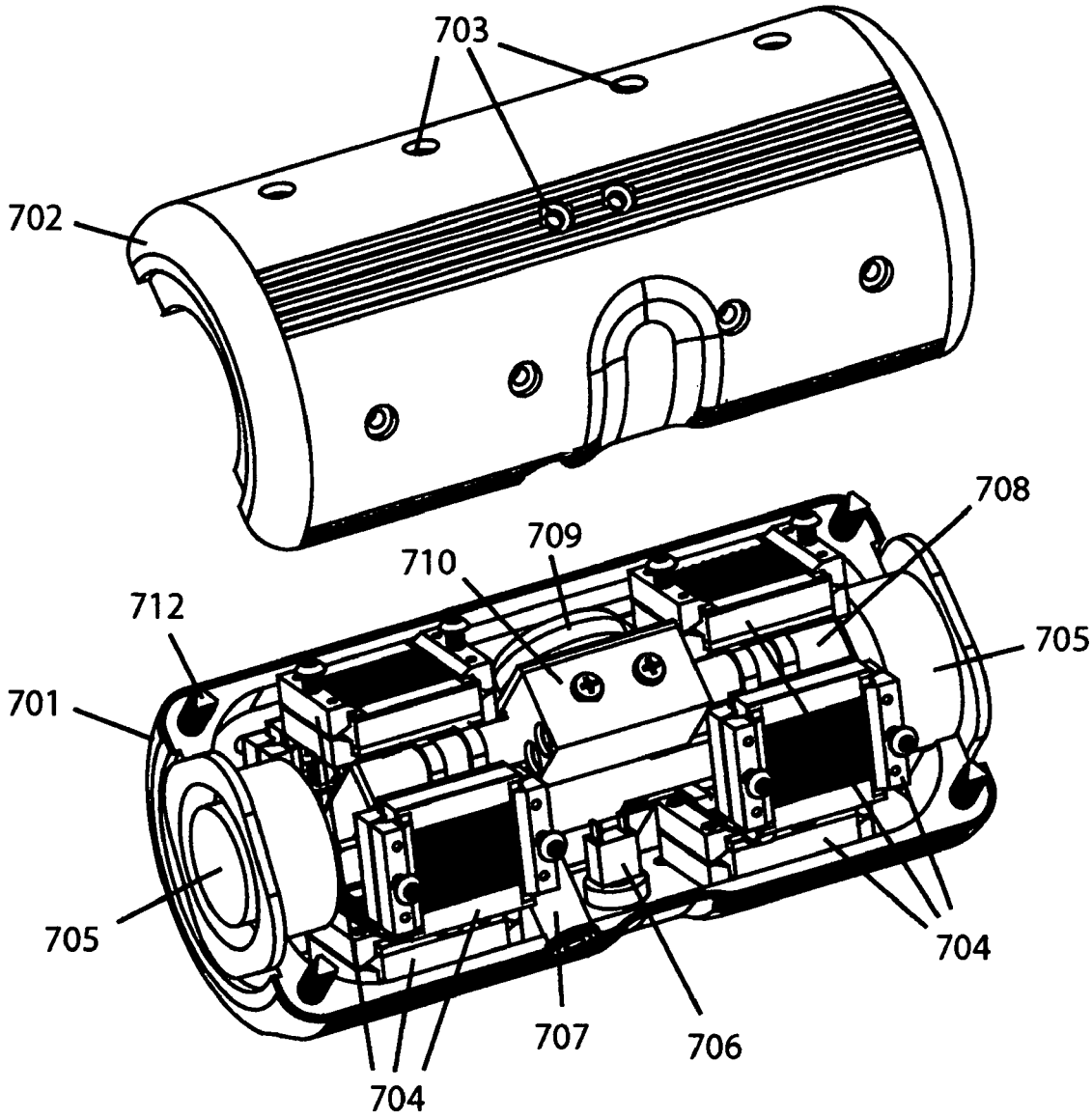
FIG. 7 is an illustration of the preferred embodiment of the projectile.

FIG. 7 shows a preferred embodiment of a non-lethal projectile for disorienting adversaries having housing 701. In this embodiment, light generator modules 704 are distributed against the interior perimeter of a hollow transparent plastic cylinder 702, four modules at each end of the cylinder, placed every 90 degrees around the circumference. The light generator modules may be pulsed at various frequencies between 4 Hz and 20 Hz to produce visual confusion and disorientation in individuals exposed to the projectile. Also in this preferred embodiment two independent sound generation modules 705, each with an audio output of between 120 and 150 dBA are used to emit annoying and distracting sounds. Preferably, the sound generator output will be in the auditory range of 500-5000 Hz, with temporally changing frequency to induce a feeling of urgency in the adversary. An additional feature of this embodiment is the ability to operate the two sound generator modules at slightly different frequencies, which produces a low-frequency beat sensation, adding to the disorienting characteristics of the sound. The preferred embodiment includes at least one light diffuser nozzle 709 and pushbutton switch 706 used for selection of the flash and sound sequence, and also for arming the projectile.

Additional functionality in a preferred embodiment includes re-usability, recharge of the internal power source through recharge connector 707, variable flash frequency/intensity, adjustable event duration, and the ability to communicate between devices and remote operation/programmability.

A preferred shape and size of the non-lethal projectile is a hand-held cylinder with a diameter of approximately 6 centimeters and a height of 12 centimeters, but larger or smaller devices may be selected. The cylinder is constructed from two halves for easy assembly, and the two halves are screwed together with fasteners 712, and through holes 703 to restrain the individual light generators and other internal components, to minimize the possibility of damage when subjected to the shock of impact during landing. The device preferably uses rechargeable lithium polymer batteries 708, and can be recovered and re-used. In the preferred embodiment of the projectile, sequencing of the light and sound generators is controlled by a microcontroller executing a software program selected from among a plurality of such software programs stored in the microcontroller. Parameters in the software program control the duration, intensity, total number of flashes, and repetition rate of each light generator module. Other parameters in the software program control the loudness and pitch of each of the sound generators. Other parameters in the software program determine the requirements for reactivation of the projectile. Preferably, the reactivation sequence is known only to the projectile's original owner, so that collection and subsequent reuse of the projectile by adversaries is prevented. The status of the projectile and its operating mode is communicated to the user through low-intensity colored status lights 710, which may be embedded in a frosted acrylic block.

Figure 8:
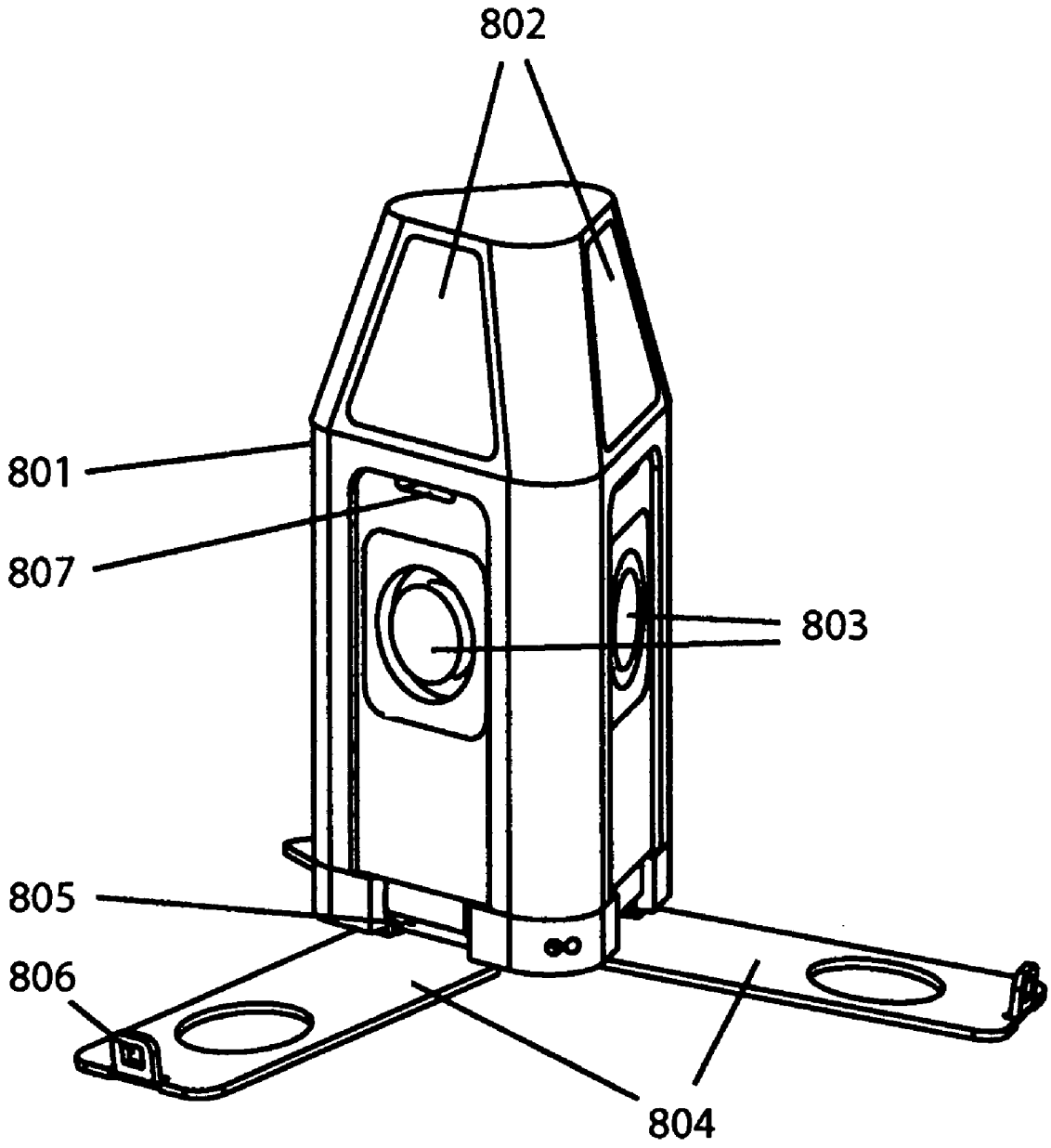
FIG. 8 is an illustration of a projectile with unfolded appendages that place the projectile in an optimized orientation.

FIG. 8 illustrates an embodiment of the non-lethal projectile with the ability to orient itself into a preferred orientation after being projected or thrown. In this embodiment, housing 801 is constructed to accommodate a plurality of light generation modules 802, a plurality of sound generation modules 803, and a plurality of hinged appendages 804. The hinged appendages are normally fastened against the housing with latch 806 and appendage release mechanism 807. Upon activation, an electrical signal from the control electronics can be used to release the release mechanism, which allows the hinged appendages to open together. The appendages are attached to the housing with a spring-loaded hinge 805, whose spring constant is sufficient to right the projectile into the preferred orientation.

Figure 9:
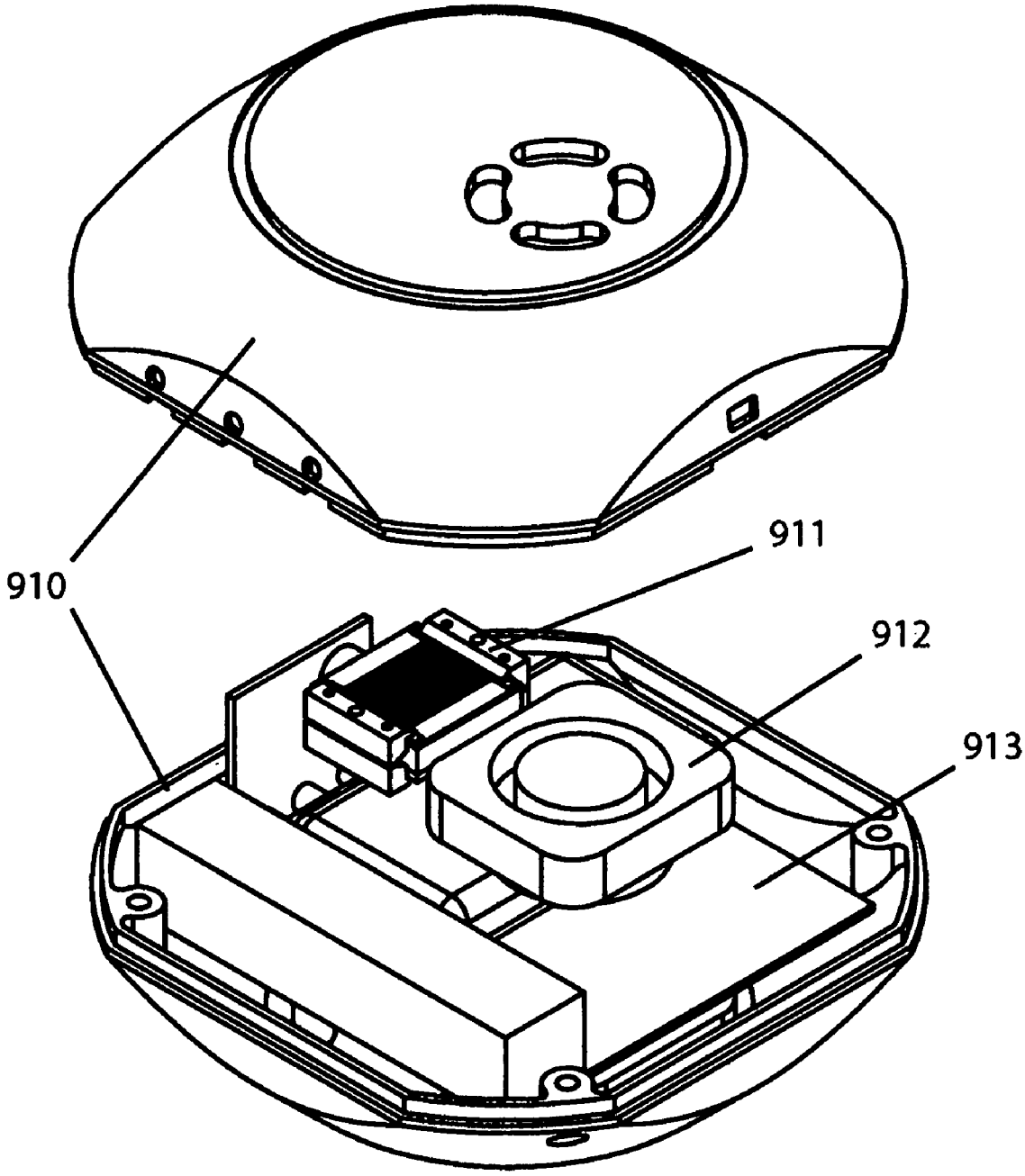
FIG. 9 is an illustration of a projectile with a prolate shape designed to land and come to rest in one of two orientations.

FIG. 9 illustrates an embodiment of the non-lethal projectile with a shape that enforces a post-landing orientation resulting in a preferred angular distribution of light from the light-generation module. Housing 910 with a prolate shape ensures that one of the two principal faces is oriented upwards. A tilt sensor incorporated in the control electronics 913 can be used to determine the orientation and to disable the operation of the light-generation module 911 and the sound-generation module 912 that are facing downward. This embodiment has the advantage that no electrical power is expended for light or sound directed into the floor.

Figure 10:
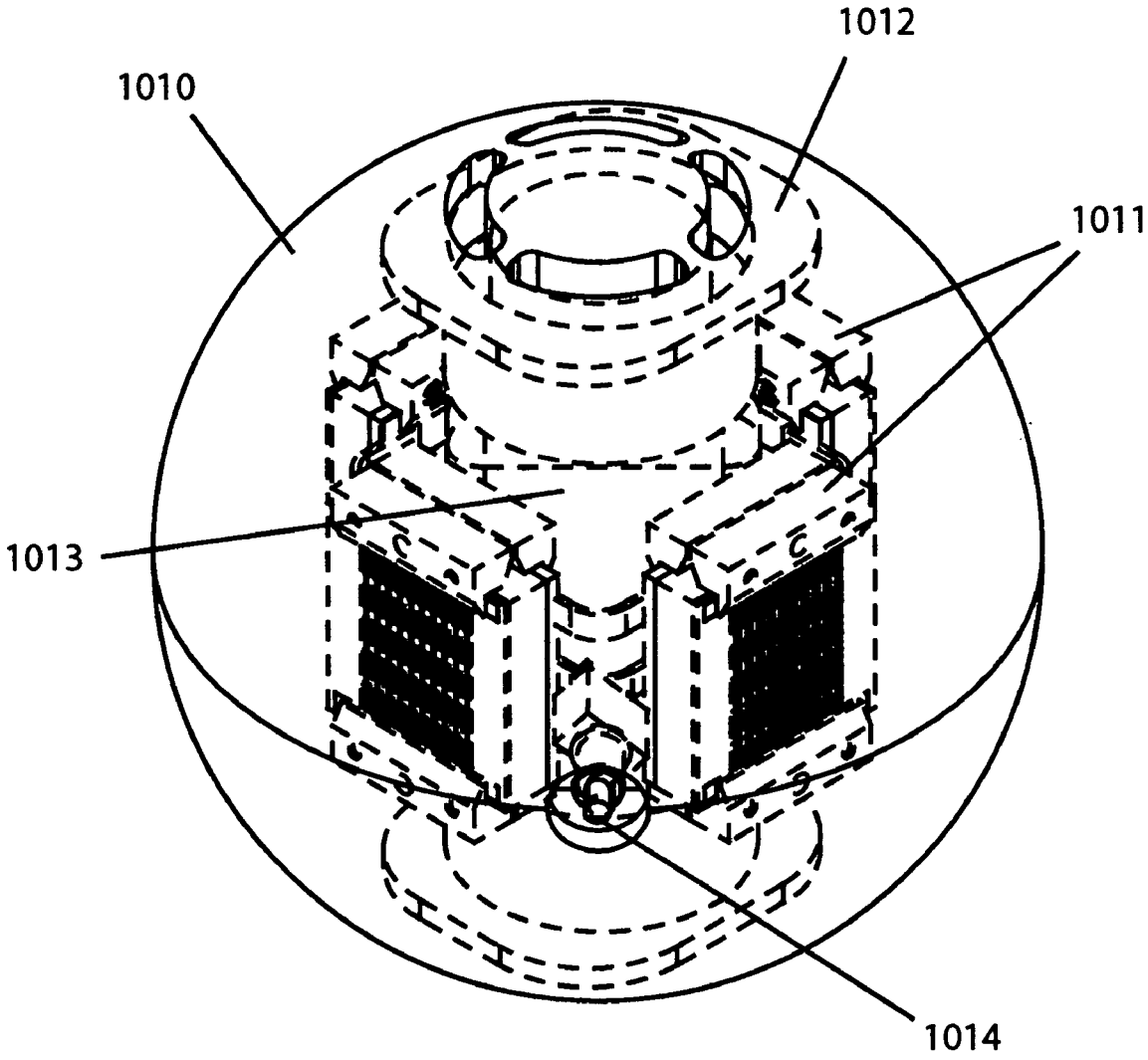
FIG. 10 is an illustration of a projectile in a spherical form factor.

FIG. 10 illustrates a non-lethal projectile with a spherical housing 1010, which enables the device to roll and deliver isotropic light and sound from concentrically-located light-generation modules 1011 and sound generation modules 1012. A recessed pushbutton 1014 interfaces with control electronics 1013 to arm and program the projectile prior to activation. An advantage of this embodiment is that the spherical shape is smaller that either the cylindrical or the prolate shapes, and is thus more easily thrown by a user. The spherical shape is also advantageous in situations where the motion of one or more rolling projectiles might enhance the distraction or disorientation effect on adversaries.

Figure 11:
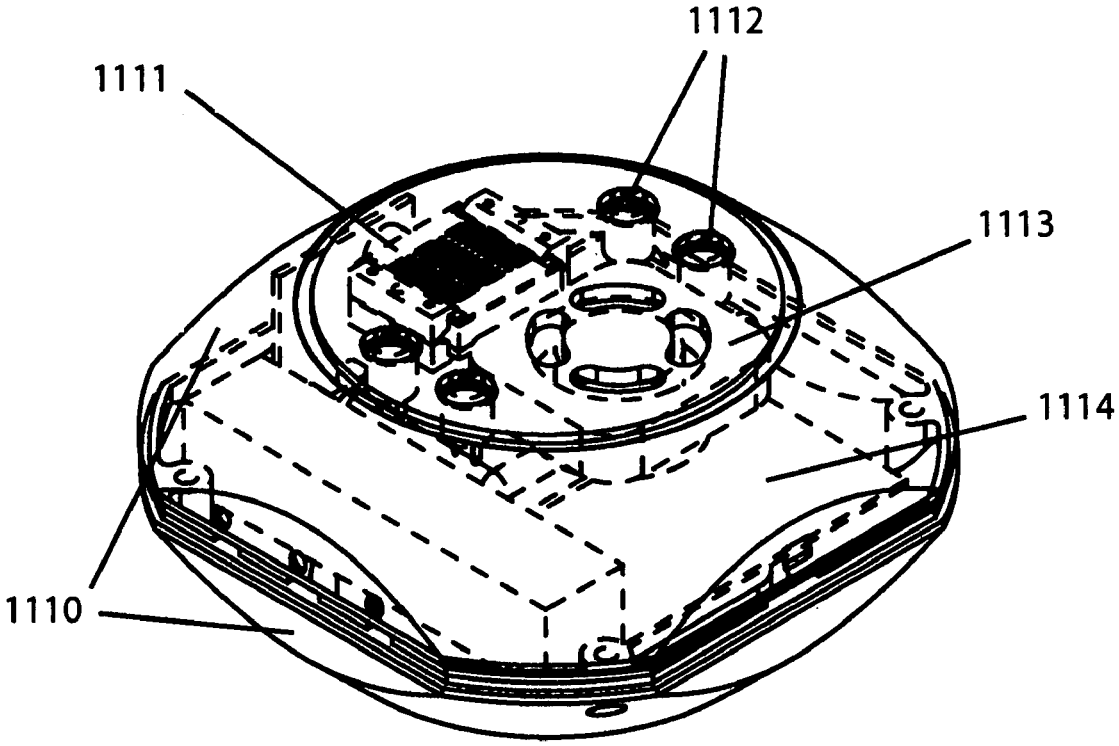
FIG. 11 is an illustration of a prolate projectile with a plurality of buttons for disarming or activating a special function of the projectile.

FIG. 11 shows a modification of the prolate non-lethal projectile of FIG. 9 that is primarily suited for the simulation of stationary bombs or mines for training, entertainment, or paintball applications. In this embodiment, the prolate housing 1110, with light-generation modules 1111, and sound generation modules 1113, is complemented by the addition of a plurality of pushbuttons 1112 which, when pushed in a particular sequence, activate a special function of the control electronics 1114. The pushbuttons may be color-coded or labeled with an alphanumeric or other symbol. The special function might include arming the projectile for a predetermined time period, disarming the projectile, or causing the projectile to activate a light and/or sound sequence without warning. One of the pushbuttons is designated the primary pushbutton and provides the same level of control as in the previously-illustrated versions of the projectile.

Also integrated within the control electronics may be sensors such as optical or infrared photodiodes that can receive a coded data stream, proximity sensors such as pyroelectric detectors that signal nearby motion of a warm object or person, motion sensors that detect changes in tilt or acceleration, or acoustic sensors that detect sound from nearby personnel. These sensors can be used to detect the presence of nearby adversaries and to signal the electronics to trigger the light generators and sound generators, simulating detonation of a bomb, mine, or similar explosive.

It is important that the method of use of the non-lethal projectile be simple, as it is intended to be used in situations where timing, stealth, and surprise are of paramount importance. All functions of the projectile may be controlled with a single pushbutton switch. To arm the projectile, the pushbutton switch may be closed for a predetermined arm time, preferably five seconds. At the end of the arm time, the color of the status light changes to red, indicating to the user that the projectile is armed. When armed, the projectile can be thrown, rolled, or launched into a room or space with multiple adversaries. Release of the pushbutton switch while the projectile is armed (normally as a consequence of projection) will cause activation of the programmed control sequence.

The control sequence begins with a selected delay time, which can be in the range of zero to 10 seconds, after which emission of either light or sound or both, and (optionally) diffuse reflecting means may occur. For an application involving tossing or throwing the projectile into a room where adversaries (one or multiple) are located, a constant delay time of one to two seconds is appropriate. For longer distance throws or launches of the projectile, the initial delay time can be lengthened so that the light and sound emission occur at or just prior to the projectile's arrival at the target location. In any case, when the light and sound functions of the projectile are activated, adversaries in the room are temporarily impaired or startled, giving the projectile's user a tactical advantage when entering the room shortly after activation of the projectile.

Typically, users of the projectile would wear hearing protection and eyewear with optical filtering or attenuation in the spectral band corresponding to the LED emission. The protective gear would protect the user from the disorienting effects of the projectile.

If multiple projectiles are in use within the same closed space, they normally operate independently of one another, and can have distinct light and sound characteristics. If the projectiles are equipped with optional transceivers, then the control electronics of all armed projectiles will synchronize with a single master projectile, and all light pulses and sound modulation may be simultaneous across all projectiles, enhancing the disorienting effect.

Once the projectile is activated, the control sequence determines the duration of light and sound, and the intensity, pulse duration, and the pulse frequency of same. The control sequence also determines the activation delays of the optional light expansion modules and the release of the optional hinged appendages. Preferably, the control sequence cannot be interrupted by manipulating the pushbutton. At the end of the control sequence, the projectile enters the safe mode, and the status light may change to flashing blue. The projectile then cannot be re-armed until a special sequence of button pushes is entered by the user. This prevents adversaries from gaining control of the projectile and directing it against the original users. Pressing the special sequence will bring the projectile into ready mode, and the status light may change to flashing green.

If the pushbutton is never released while the projectile is in the armed state, after a certain predetermined abort time, the projectile will exit the armed state, enter the ready state, and the status light will change to flashing green, indicating that the projectile is ready to be armed again, if desired. The abort time may be between five and ten seconds.

For use in the game of paintball or other similar simulated warfare games, the non-lethal projectile can be used to disorient or confuse adversaries just as in actual military and law-enforcement scenarios, or a version of the projectile with light generation modules that emit a lower radiant power, and sound generation modules that emit less than 120 dBA sound level can be used to simulate the effect of a pyrotechnic flash-bang grenade. Alternately, when activated as a grenade simulator, all personnel within a specified radius of the projectile would be declared "dead" and would leave the game. The lower light and sound levels would eliminate the necessity for users to wear additional hearing and eye protection beyond what is already being used in the game.

The embodiment of the non-lethal projectile with a plurality of pushbuttons is also ideal for use in training scenarios, paintball, or simulated warfare games as a more sophisticated device that can be triggered by remote control, proximity, and optionally has the potential to be disarmed or rendered inoperative by pressing the correct sequence of pushbuttons. A user would use the primary pushbutton to arm the device in a particular mode with a particular time delay. If not disarmed prior to a remote trigger or expiration of a time delay, the device would automatically activate the light and sound generation modules, simulating detonation. To disarm the device, either the original user or another person would have to actuate the pushbuttons in a pre-arranged sequence prior to expiration of the preset time delay. Mistakes in the sequence or an incorrect sequence could cause immediate "detonation" of the device. The provision of multiple disarming sequences or status light indications that indicate disarming even though the device activates a short time later are possible and are easily programmed in the control electronics.

Alternately, the activation of the device could be triggered by remote control, or by the detection of sound, motion, light, or heat by acoustic, pyroelectric, accelerometer, or photodiode sensors, respectively, connected to the device's control electronics. This would simulate the action of a bomb, mine, or improvised explosive device (IED). This mode of operation would have utility for the training of military personnel in mine-clearing and IED mitigation roles.

Although the present invention has been described with reference to specific details, it is not intended that such details should be regarded as limitations on the scope of the invention, except to the extent that they are included in the accompanying claims.

What we claim is:

1. A non-lethal projectile for disorienting adversaries, comprising:

a housing, the housing having a transparent segment;

a plurality of light-emitting diode arrays for emitting visible light in a first selected range of wavelengths, wherein each array of light-emitting diodes comprises a printed circuit and the printed circuit is in thermal contact with a heat sink;

an electrical power source; and control electronics to operate the array of light-emitting diodes in a selected time sequence, a tilt sensor mounted within the housing, and tilt responsive control electronics in said housing to receive a signal from the tilt sensor, said tilt sensor being capable of determining the orientation of the projectile and capable of disabling less than all of the arrays.

2. The projectile of claim 1 further comprising an operator switch accessible to an operator of the projectile.

3. The projectile of claim 2 further comprising a trigger activated by a sensor that is sensitive to motion, sound, infrared radiation or optical radiation.

4. The projectile of claim 1 wherein the array of light-emitting diodes emits visible light at a wavelength near the wavelength of peak sensitivity of human eyes.

5. The projectile of claim 1 wherein the array of light-emitting diodes emits visible light at a center wavelength between 500 and 555 nm.

6. The projectile of claim 1 further comprising a sound generator and control electronics to operate the sound generator in a selected time sequence.

7. The projectile of claim 1 further comprising a hinged appendage attached to the housing for controlling orientation of the housing and control electronics to operate the hinged appendage at a selected time.

8. The projectile of claim 1 further comprising a transceiver and control electronics to receive a signal from the transceiver.

9. The projectile of claim 1 further comprising a nozzle for dispersing a powder or aerosol from the housing.

10. The projectile of claim 1 further comprising a diffuser nozzle for inflating a diffuser from the housing.

11. The projectile of claim 1 further comprising a second array of light-emitting diodes, wherein the second array of light-emitting diodes comprises a printed circuit and the printed circuit is in thermal contact with a heat sink, the second array of light-emitting diodes emitting light in a second selected range of wavelengths.

12. A non-lethal projectile as claimed in claim 1 wherein the printed circuit board includes a plurality of LEDs in die form, a conducting anode trace, a circuit trace, wherein a cathode connection is made by a wire bond from a top surface of the LED die to an adjacent circuit trace.

13. A non-lethal projectile for disorienting adversaries, comprising:

a housing, the housing having a transparent segment;

a plurality of light-emitting diode arrays for emitting visible light in a first selected range of wavelengths, wherein each array of light-emitting diodes comprises a printed circuit and the printed circuit is in thermal contact with a heat sink;

an electrical power source;

control electronics to operate the array of light-emitting diodes in a selected time sequence, a tilt sensor mounted within the housing, tilt responsive control electronics in said housing to receive a signal from the tilt sensor;

the housing having a prolate shape with two principal faces;

at least one array of light emitting diodes mounted on each principal face; and the tilt sensor being capable of sensing the orientation of the arrays and the control electronics adapted to disable the operation of a downward facing array.

* * * * *